US011746635B1

(12) United States Patent
Kabrich et al.

(10) Patent No.: US 11,746,635 B1
(45) Date of Patent: Sep. 5, 2023

(54) OPTIMIZING OPERATIONS OF A HYDRAULIC FRACTURING SYSTEM

(71) Applicant: Caterpillar Inc., Peoria, IL (US)

(72) Inventors: Todd R. Kabrich, Tomball, TX (US); Andy Publes, Katy, TX (US); Casey A. Otten, Spring, TX (US); Brandon J. Mabe, Houston, TX (US); Perry D. Converse, Lafayette, IN (US); Jason T. Herlehy, The Woodlands, TX (US); Joseph C. Bufkin, Spring, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/692,948

(22) Filed: Mar. 11, 2022

(51) Int. Cl.
*E21B 43/26* (2006.01)
*F04B 49/00* (2006.01)
*F04B 49/06* (2006.01)

(52) U.S. Cl.
CPC ..... *E21B 43/2607* (2020.05); *F04B 49/007* (2013.01); *F04B 49/065* (2013.01); *E21B 2200/20* (2020.05); *E21B 2200/22* (2020.05)

(58) Field of Classification Search
CPC ..... E21B 43/26; E21B 43/2607
See application file for complete search history.

(56) References Cited

U.S. PATENT DOCUMENTS 8,205,594 B2 6/2012 Fore et al.
9,255,531 B2 2/2016 Zhang et al.
9,683,503 B2 6/2017 Zhang et al.
9,889,915 B2 2/2018 Zhang et al.
9,896,982 B1 2/2018 Zhang et al.
10,415,348 B2 9/2019 Zhang et al.
10,458,352 B2 10/2019 Zhang et al.
(Continued)

FOREIGN PATENT DOCUMENTS

CN 102602322 A 7/2012
WO WO-2023014719 A1 * 2/2023

OTHER PUBLICATIONS

Unpublished U.S. Appl. No. 17/110,415, filed Dec. 3, 2020, available through USPTO IFW System (not provided per Waiver of the Copy Requirement in 37 CFR 1.98 for Cited Pending U.S. Patent Applications).

(Continued)

*Primary Examiner* — Matthew R Buck
(74) *Attorney, Agent, or Firm* — Bookoff McAndrews, PLLC

(57) ABSTRACT

A method may include receiving information related to operation or a configuration of a hydraulic fracturing system, The hydraulic fracturing system may include one or more fracturing rigs, one or more blending equipment, and one or more power sources electrically connected to a first subset of the one or more fracturing rigs, or one or more fuel sources fluidly connected to a second subset of the one or more fracturing rigs. The hydraulic fracturing system may further include one or more missile valves, one or more zipper valves, one or more well head valves, and one or more well heads. The method may further include optimizing the operation of one or more subsystems of the hydraulic fracturing system using a particle swarm algorithm. The method may further include outputting one or more control signals to the one or more subsystems based on optimizing the operation.

20 Claims, 5 Drawing Sheets

(56) References Cited

U.S. PATENT DOCUMENTS

| | | | | |
|---|---|---|---|---|
| 10,563,649 | B2 | 2/2020 | Zhang et al. | |
| 10,734,814 | B2 | 8/2020 | Converse et al. | |
| 10,760,996 | B2 | 9/2020 | Converse et al. | |
| 10,890,061 | B2 | 1/2021 | Cai et al. | |
| 10,927,774 | B2 | 2/2021 | Cai et al. | |
| 11,035,207 | B2 | 6/2021 | Oehring et al. | |
| 11,085,281 | B1 | 8/2021 | Yeung et al. | |
| 2017/0012439 | A1 | 1/2017 | Zhang et al. | |
| 2017/0130712 | A1 | 5/2017 | Zhang et al. | |
| 2022/0003229 | A1* | 1/2022 | Mu | F04B 17/06 |
| 2022/0214474 | A1* | 7/2022 | Nistala | E21B 47/07 |
| 2023/0024323 | A1* | 1/2023 | Fripp | E21B 43/2607 |

OTHER PUBLICATIONS

Unpublished GB Patent Application No. 2105452.3, filed Apr. 16, 2021, provided with this SB08.

* cited by examiner

OPTIMIZING OPERATIONS OF A HYDRAULIC FRACTURING SYSTEM

TECHNICAL FIELD

The present disclosure relates generally to a hydraulic fracturing system, and more particularly, to optimizing operations of a hydraulic fracturing system.

BACKGROUND

Hydraulic fracturing is a means for extracting oil and gas from rock, typically to supplement a horizontal drilling operation. In particular, high-pressure fluid is used to fracture the rock, stimulating the flow of oil and gas through the rock to increase the volumes of oil or gas that can be recovered. A hydraulic fracturing rig used to inject high-pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at the same or different pressures to achieve a flow rate for the fluid (e.g., measured in barrels per minute). However, operation of the hydraulic fracturing rigs does not take into account other considerations, such as the total emissions produced by the hydraulic fracturing rigs or fuel consumption cost of the hydraulic fracturing rigs. For example, these rigs exhaust a complex mixture of air pollutants that are generally composed of particulates and gaseous compounds including nitrogen oxides (commonly referred to as "NOx") and carbon dioxide (commonly referred to as "$CO_2$") or carbon dioxide equivalents ($CO_2e$), among others. Due to increased awareness of the environment, exhaust emission standards have become more stringent, and the amounts of particulates and gasses emitted into the atmosphere by a hydraulic fracturing rig may be regulated depending on, for example, the location in which the hydraulic fracturing rig is operating or the type of fuel used to power the hydraulic fracturing rig. Furthermore, emissions from a hydraulic fracturing rig may have associated costs imposed by regulatory organizations based on the amount of emissions from the hydraulic fracturing rig. In addition to emissions, fuel consumption, maintenance, etc. may have variable costs depending on location of the hydraulic fracturing rig, efficiency of the hydraulic fracturing rig, and the like.

U.S. Pat. No. 11,035,207, issued on Jun. 15, 2021 ("the '207 patent") describes that a data van is provided to monitor and control hybrid fracturing fleets. In particular, the '207 patent describes that a controller determines a type of component (diesel-powered or electric-powered) connected to the data van and switches between the diesel-powered components and the electric-powered components upon determination by the controller that the type of component is connected. However, the '207 reference does not optimize a hydraulic fracturing system, e.g., for fuel consumption, emissions, maintenance, etc.

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may include one or more missile valves fluidly connected to outlets of the one or more fracturing rigs, one or more zipper valves fluidly connected to outlets of the one or more missile valves, one or more well head valves fluidly connected to outlets of the one or more zipper valves, and one or more well heads fluidly connected to outlets of the one or more well head valves. The hydraulic fracturing system may further include a controller configured to receive operation-related information for one or more subsystems of the hydraulic fracturing system. The controller may be further configured to optimize operation of the one or more subsystems of the hydraulic fracturing system using a particle swarm algorithm. The controller may be further configured to output one or more control signals to the one or more subsystems based on optimizing the operation.

In another aspect, a method may include receiving information related to operation or a configuration of a hydraulic fracturing system, The hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to outlets of the one or more fracturing rigs, one or more zipper valves fluidly connected to outlets of the one or more missile valves, one or more well head valves fluidly connected to outlets of the one or more zipper valves, and one or more well heads fluidly connected to outlets of the one or more well head valves. The method may further include optimizing the operation of one or more subsystems of the hydraulic fracturing system using a particle swarm algorithm. The method may further include outputting one or more control signals to the one or more subsystems based on optimizing the operation.

A controller for a hydraulic fracturing site may be configured to receive information related to operation or a configuration of a hydraulic fracturing system at the hydraulic fracturing site. The hydraulic fracturing system may include one or more fracturing rigs, one or more blending equipment fluidly connected to inlets of the one or more fracturing rigs, and one or more power sources electrically connected to a first subset of the one or more fracturing rigs, or one or more fuel sources fluidly connected to a second subset of the one or more fracturing rigs. The hydraulic fracturing system may further include one or more missile valves fluidly connected to outlets of the one or more fracturing rigs, one or more zipper valves fluidly connected to outlets of the one or more missile valves, one or more well head valves fluidly connected to outlets of the one or more zipper valves, and one or more well heads fluidly connected to outlets of the one or more well head valves. The controller may be further configured to optimize the operation of one or more subsystems of the hydraulic fracturing system using a particle swarm algorithm. The controller may be further configured to output one or more control signals to the one or more subsystems based on optimizing the operation.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
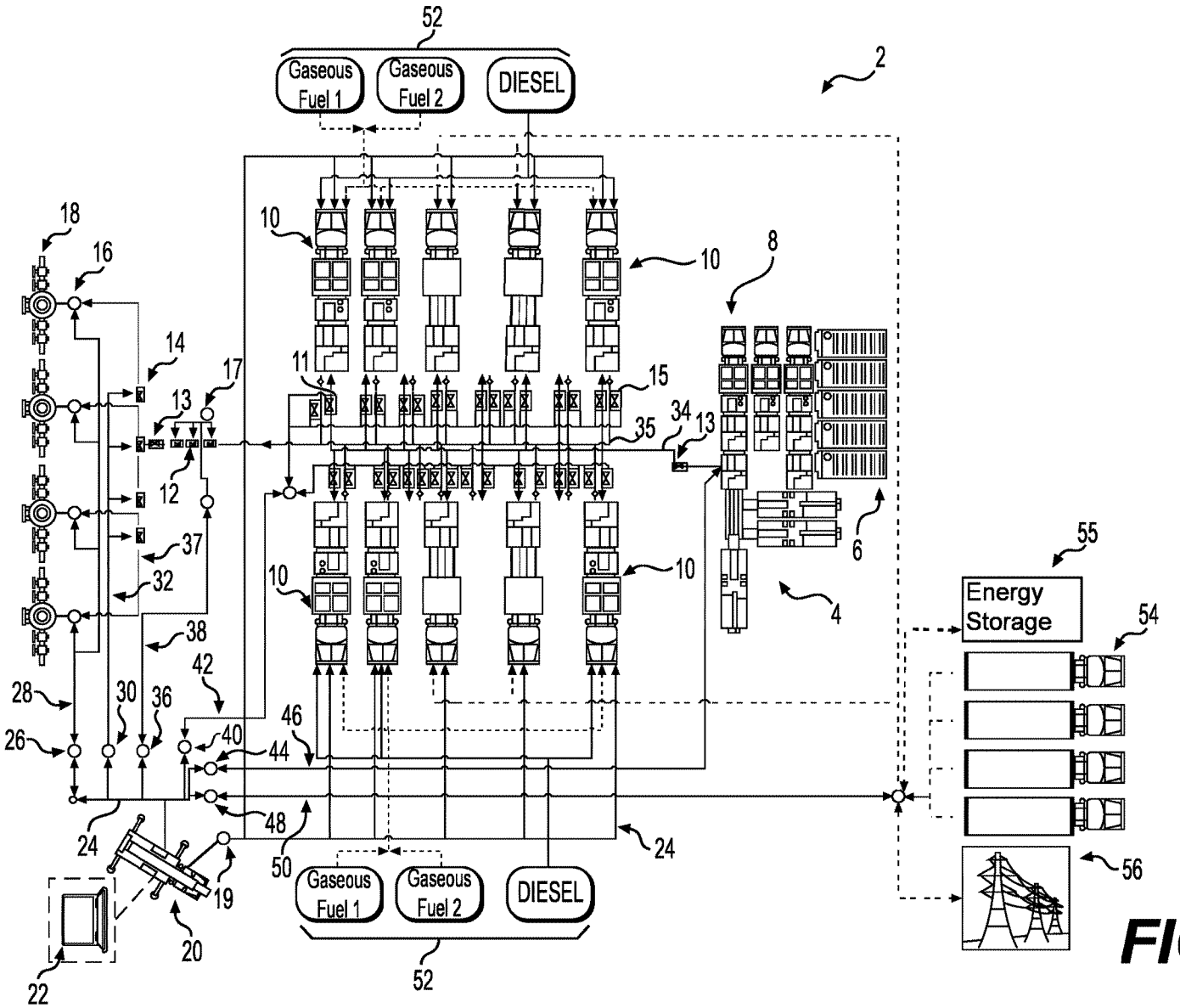
FIG. 1 is a schematic diagram of exemplary hydraulic fracturing systems including a plurality of fracturing rigs, energy sources, and fuel types according to aspects of the disclosure.

FIG. 1 illustrates an exemplary hydraulic fracturing system 2 according to aspects of the disclosure. In particular, FIG. 1 depicts an exemplary site layout according to a well stimulation stage (e.g., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at pressure through one or more low pressure fluid lines 34 to one or more fracturing rigs 10 (FIG. 1 illustrates ten fracturing rigs 10 and two types of fracturing rigs—4 electric fracturing rigs 10 and 6 hydraulic fracturing rigs 10). One or more types of fracturing rigs 10 may be used in connection with certain embodiments, such as mechanical fracturing rigs 10, hydraulic fracturing rigs 10, electric fracturing rigs 10, and/or the like. The one or more fracturing rigs 10 may pump the fracturing fluid at high pressure to a well head 18 (FIG. 1 illustrates four well heads 18) through one or more high-pressure fluid lines 35. The one or more fracturing rigs 10 may be controlled by one or more rig controllers 19 (e.g., a rig controller 19 may receive, process, and/or provide to the fracturing rigs 10 a desired flow or pressure for a job).

A bleed off tank (not shown in FIG. 1) may be provided to receive bleed off liquid or gas from the fluid lines 34 and/or 35 (e.g., via one or more automatic pressure relief valves 13). In addition, nitrogen, which may be beneficial to the hydraulic fracturing process for a variety of reasons, may be stored in tanks, with a pumping system (not shown in FIG. 1) used to supply the nitrogen from the tanks to the fluid lines 35 or a well head 18.

In order to control flow of fluid, the hydraulic fracturing system 2 may include various types of valves. For example, the hydraulic fracturing system 2 may include one or more low pressure missile valves 11 upstream from the inlet of hydraulic fracturing pumps of the fracturing rigs 10 (e.g., an inlet of the low pressure missile valves 11 may be fluidly connected to fluid lines 34 and outlets of the low pressure missile valves 11 may be fluidly connected to the inlets of the hydraulic fracturing pumps). For example, the low pressure missile valves 11 may control fluid flow from fluid lines 34 to the hydraulic fracturing pumps of the fracturing rigs 10. Additionally, or alternatively, the hydraulic fracturing system 2 may include one or more check valves 15 (e.g., actuated or one-way check valves 15) that may be upstream from a fracturing tree being served by the fracturing rigs 10 (e.g., outlets of the pumps of the fracturing rigs 10 may be fluidly connected to inlets of the check valves 15 and outlets of the check valves 15 may be fluidly connected to inlet(s) of the fracturing tree). Additionally, or alternatively, the hydraulic fracturing system 2 may include one or more large bore valves 12 (e.g., on/off ball valves) of a grease system (FIG. 1 illustrates three large bore valves 12). "Large bore" may refer to a line where flow is consolidated into one line and large bore valves 12 may shut the well off from missile lines. The hydraulic fracturing system 2 may include a system 17 that may gather data related to the hydraulic fracturing system 2 and may provide the data to the controller 58 for event correction and/or maintenance monitoring. For example, the controller 58 may track maintenance based on the data from the system 17 and may send a message to an operator or to the system 17 to grease the large bore valves 12, e.g., after a certain number of cycles of opening/closing the large bore valves 12. One or more other similar systems may be included in the hydraulic fracturing system 2 for monitoring operations of certain elements of the hydraulic fracturing system 2 and/or for taking corrective or maintenance-related actions. The large bore valves 12 may be downstream of outlets of the check valves 15 (e.g., inlets of the large bore valves 12 may be fluidly connected to outlets of the check valves 15). Additionally, or alternatively, the hydraulic fracturing system 2 may include one or more automatic pressure relief valves 13 (FIG. 1 illustrates one automatic pressure relief valve 13). For example, the automatic pressure relief valves 13 may be downstream of the one or more large bore valves 12 (e.g., inlets of the one or more automatic pressure relief valves 13 may be fluidly connected to outlets of the one or more large bore valves 12). The automatic pressure relief valves 13 may be controlled and/or triggered automatically to release fluid pressure from fluid lines 35. Additionally, or alternatively, the hydraulic fracturing system 2 may include one or more zipper valves 14 (FIG. 1 illustrates four zipper valves 14) downstream of the automatic pressure relief valves 13 (e.g., outlets of the automatic pressure relief valves 13 may be fluidly connected to inlets of the zipper valves 14). The zipper valves 14 may control fluid flow from fluid lines 35 to individual well heads 18 via zipper piping 37 (e.g., zipper piping may fluidly connect large bore valves 12 to the well heads 18). The hydraulic fracturing system 2 may further include one or more well head valves 16 (FIG. 1 illustrates four well head valves 16) downstream of the outlet of the zipper valves 14 (e.g., outlets of the zipper valves 14 may be fluidly connected to inlets of the well head valves 16). The well head valves 16 may provide further fluid control to the well heads 18 from the fluid lines 35.

The hydraulic fracturing process performed at the site, using the hydraulic fracturing system 2 of the present disclosure, and the equipment used in the process, may be managed and/or monitored from a single location, such as a data monitoring system 20, located at the site or at additional or alternative locations. According to an example, the data monitoring system 20 may be supported on a van, truck or may be otherwise mobile. As will be described below, the data monitoring system 20 may include a user device 22 for displaying or inputting data for monitoring performance and/or optimizing operation of the hydraulic fracturing system 2 and/or the fracturing rigs 10. According to one embodiment, the data gathered by the data monitoring system 20 may be sent off-board or off-site for monitoring, recording, or reporting of performance of the hydraulic fracturing system 2 (or elements of the hydraulic fracturing system 2) and/or for performing calculations related to the hydraulic fracturing system 2.

The data monitoring system 20 (or a controller of the data monitoring system 20) may be communicatively connected to one or more controllers of the hydraulic fracturing system 2 that control subsystems of the hydraulic fracturing system 2. For example, the data monitoring system 20 may be connected to the controllers via wired or wireless communication channels 24 The controllers may include a well head valve controller 26 connected to the one or more well head valves 16 and/or well heads 18 via a wired or wireless communication channel 28. The well head valve controller 26 may be configured to actuate the one or more well head valves 16 and/or one or more mechanical components of the well heads 18. Actuation of a valve or a well head 18 may include actuating one or more mechanical components to an open state, to a closed state, or to a partially closed or partially open state. Actuation, as described herein, may be performed by an associated actuator that may be integrated with the component to be actuated or may be a separate component (e.g., electric actuation of a valve may be performed through the use of an actuator integrated with a valve whereas hydraulic actuation may be performed through the use of an actuator located remote to the valve). Additionally, or alternatively, the controllers may include a zipper valve controller 30 connected to the one or more zipper valves 14 via a wired or wireless communication channel 32. The zipper valve controller 30 may be configured to actuate the one or more zipper valves 14.

The controllers may, additionally, or alternatively, include a large bore valve controller 36 connected to the one or more large bore valves 12 via a wired or wireless communication channel 38. The large bore valve controller 36 may be configured to actuate the one or more large bore valves 12. The controllers may further include a valve controller 40 connected to the one or more low pressure missile valves 11 and/or the one or more check valves 15 via a wired or wireless communication channel 42. The valve controller 40 may be configured to actuate the one or more low pressure missile valves 11 and/or the one or more check valves 15.

Additionally, or alternatively, the controllers may include a blender controller 44 connected to the blending equipment 8 via a wired or wireless communication channel 46. The blender controller 44 may be configured to control operations of the blending equipment 8 (e.g., to control preparation of the fracturing fluid). The controllers may further include a power source controller 48 connected to various power sources (e.g., generators 54, such as gaseous or blended generators 54, energy storages 55, such as batteries or fuel cells, and/or a utility power grid 56) included in the hydraulic fracturing system 2 via a wired or wireless communication channel 50. The generators 54 illustrated in FIG. 1 may be mobile generators 54 and may include turbine-based generators 54 or engine-based generators 54. Other power sources may include renewable energy sources, such as solar cells, wind turbines, and/or the like from a micro-grid. The power source controller 48 may be configured to control one or more power sources and/or to control the provisioning of power from the power sources. For example, the power source controller 48 may power on or power off a generator 54 to meet power expectations, may switch one or more equipment of the hydraulic fracturing system 2 from consuming power from the utility power grid 56 to consuming power from one or more generators 54 and/or energy storages 55 (or vice versa), and/or the like.

Fuel sources 52 may provide fuel (e.g., gas, compressed natural gas (CNG), hydrogen (H2), propane, field gas, diesel, etc.) to the mechanical fracturing rigs 10. The provisioning of fuel to the fracturing rigs 10 may be controlled by a controller associated with the data monitoring system 20 and/or one or more other controllers associated with the fuel sources.

Generators 54 may provide energy to fracturing rigs 10. The provisioning of energy to the fracturing rigs 10 may be controlled by a controller associated with the data monitoring system 20 and/or one or more other controllers associated with the fuel sources.

Elements of the hydraulic fracturing system 2 may be configured to operate in one or more operational modes. The one or more operational modes may include a manual mode where, for example, an operator programs desired operational parameters for elements of the hydraulic fracturing system 2 via the user device 22 and the operator ramps the hydraulic fracturing system 2 to the desired operational parameters via the user device 22. In addition, in the manual mode, the operator may, via the user device 22, approve or decline optimized operational parameters determined by data monitoring system 20, according to certain embodiments described herein. Additionally, or alternatively, the one or more operational modes may include a semi-closed mode where, for example, the operator ramps the hydraulic fracturing system 2 to desired operational parameters via the user device 22, and a controller 58 may optimize the operation of the hydraulic fracturing system 2 based on operator input (e.g., fuel optimization, emissions optimization, total cost of ownership optimization, and/or the like).

Additionally, or alternatively, the one or more operational modes may include a closed mode where, for example, the operator programs the desired operational parameters via the user device 22, and one or more controllers (e.g., controller 58 and/or controllers 64) ramp the operation of the hydraulic fracturing system 2 to the desired and/or optimized operational parameters. Additionally, or alternatively, the one or more operational modes may include an autonomous mode where, for example, the operator is remote to the data monitoring system 20 and/or a hydraulic fracturing site, and one or more controllers (e.g., controller 58 and/or controllers 64) may monitor and control the operational parameters of the hydraulic fracturing system 2 automatically (e.g., automatically ramp operation of the hydraulic fracturing system 2 to desired operational parameters, determine and implement optimized operational parameters, etc.). The autonomous mode may additionally include operating in the closed mode with sub-controllers for valves of the hydraulic fracturing system 2. Additionally, or alternatively, the one or more operational modes may include a multi-site mode where, for example, the operator can monitor and/or control operations of multiple hydraulic fracturing systems 2 at different sites. In some embodiments, the multi-site mode may include operating in the autonomous mode across multiple fracturing sites.

Figure 2:
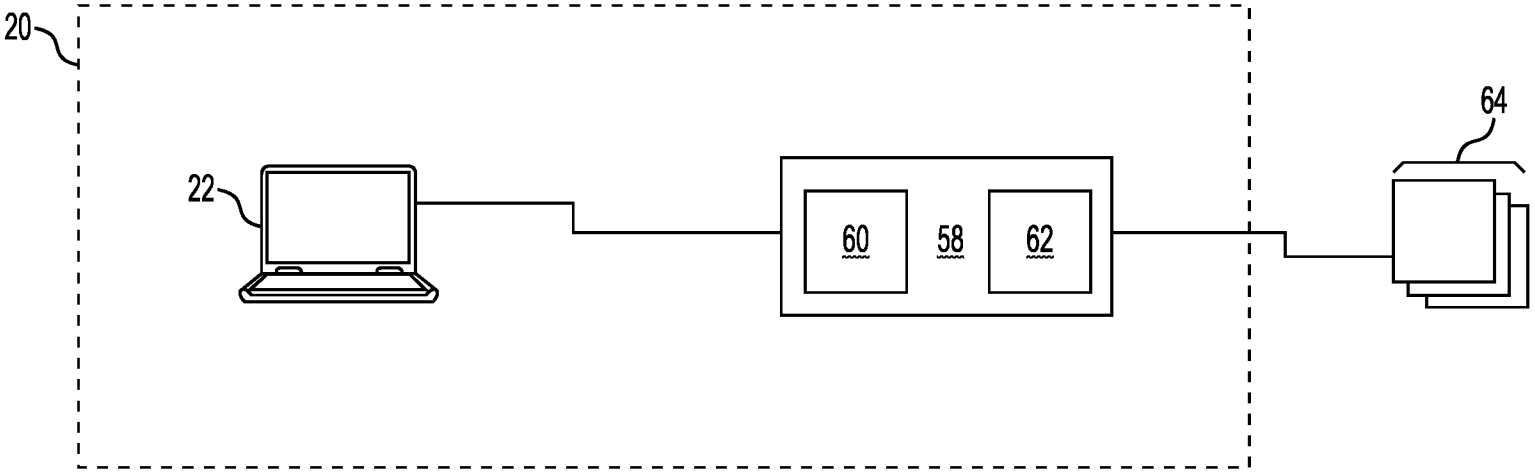
FIG. 2 is a schematic diagram of a data monitoring system and associated controllers of the hydraulic fracturing system of FIG. 1, according to aspects of the disclosure.

Referring to FIG. 2, the data monitoring system 20 may include the user device 22 and a controller 58. The controller 58 may be provided, and may be part of, or may communicate with, the data monitoring system 20. The controller 58 may reside in whole or in part at the data monitoring system 20, or elsewhere relative to the hydraulic fracturing system 2. The user device 22 and the controller 58 may be communicatively connected to each other via one or more wired or wireless connections for exchanging data, instructions, etc. Further, the controller 58 may be configured to communicate with one or more controllers 64 via wired or wireless communication channels. For example, the controller 58 may monitor and control, via the controllers 64, various subsystems of the hydraulic fracturing system 2. The controllers 64 may include the rig controller 19, the well head valve controller 26, the zipper valve controller 30, the large bore valve controller 36, the valve controller 40, the blender controller 44, and/or the power source controller 48.

The controllers 64 may be configured to communicate with one or more sensors (not shown in FIG. 2) located on elements of the hydraulic fracturing system 2. For example, the valve controller 40 may be configured to communicate with one or more sensors located at one or more valves, at components (e.g., an engine, a pump, etc.) of a fracturing rig 10, etc. A sensor may be configured to detect or measure one or more physical properties related to operation and/or performance of the various elements of the hydraulic fracturing system 2. For example, a sensor may be configured to provide a sensor signal indicative of a state of a valve (e.g., open, closed, a percentage open, or a percentage closed) to one or more of the controllers 64, which may be configured to provide the sensor signal to the controller 58.

The controller 58 and/or the controllers 64 may include a processor and a memory (not illustrated in FIG. 2). The processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor may possess its own local memory, which also may store program modules, program data, and/or one or more operating systems. The processor may include one or more cores.

The memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 22, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the controller 58 and/or the controllers 64.

The memory may be capable of storing various computer readable instructions for performing certain operations described herein (e.g., operations of the controller 58 and/or the controllers 64). The instructions, when executed by the processor and/or the hardware logic component, may cause certain operations described herein to be performed.

The controller 58 may store and/or execute an optimization program 60 to optimize operations of the hydraulic fracturing system 2 (e.g., based on data stored in the memory or as otherwise provided to the controller 58, such as via the user device 22, gathered by the controllers 64, or from a database). The controller 58 may store and/or execute a control logic program 62 (as described in more detail below with respect to FIG. 4). Data used by the controller 58 may include site configuration-related information, scheduling-related information, cost-related information, emissions-related information, operation-related or state-related information, system operating parameters, and/or the like. However, various other additional or alternative data may be used.

Figure 3:
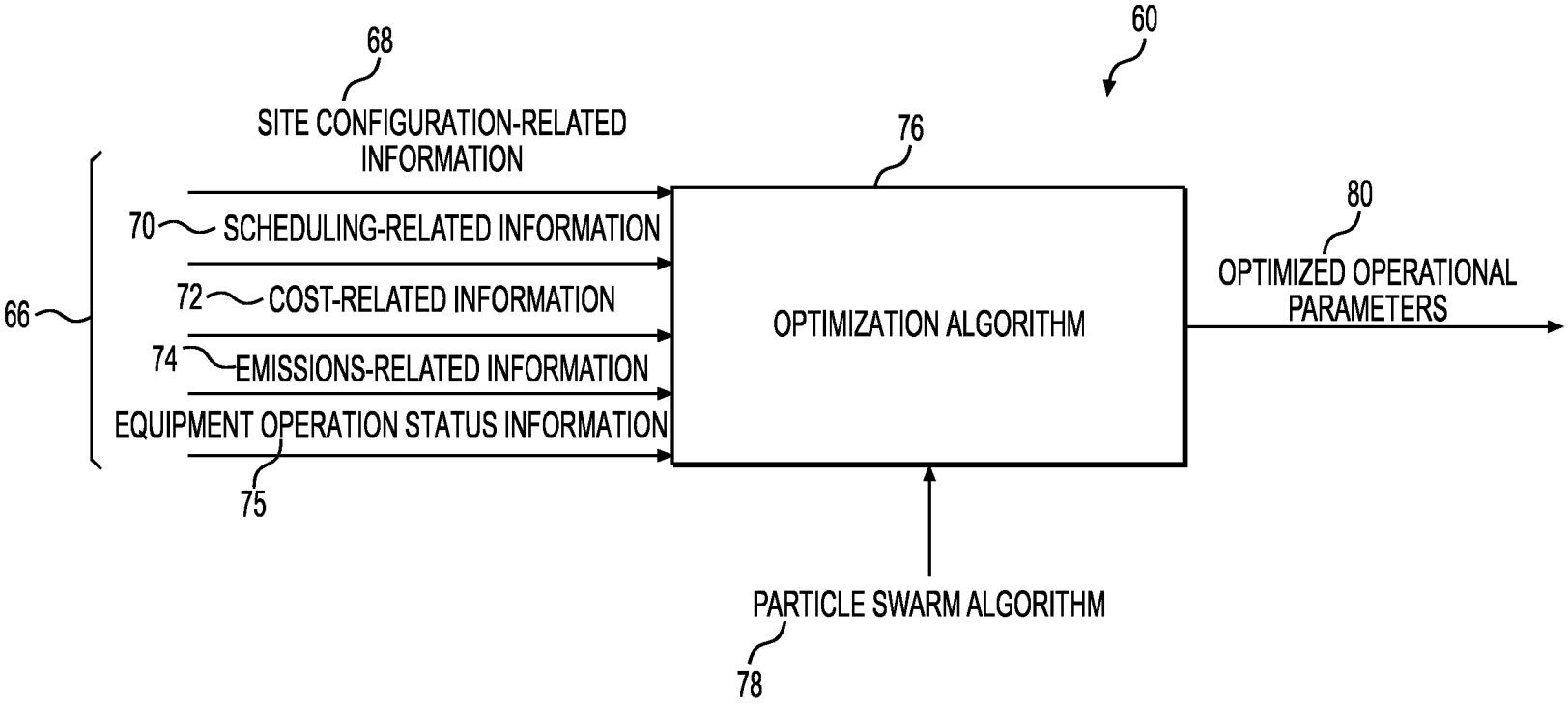
FIG. 3 is a diagram illustrating an exemplary optimization program, according to aspects of the disclosure.

FIG. 3 is a diagram illustrating an exemplary optimization program 60, according to aspects of the disclosure. As illustrated in FIG. 3, the optimization program 60 may receive input data 66 and may use the input data 66 with an optimization algorithm 76. For example, the optimization program 60 may receive the input data 66 from the user device 22 (e.g., a user may input the input data 66 via the user device 22), from a server device, from a database, from memory of various equipment of the hydraulic fracturing system 2 or components thereof, and/or the like. The optimization program 60 may receive the input data 66 as a stream of data during operation of the hydraulic fracturing system 2, prior to starting operations of the hydraulic fracturing system 2, and/or the like. The input data 66 may be pre-determined and provided to the optimization program 60 (e.g., may be based on experimental or factory measurements of equipment), may be generated by the controller 58 (e.g., the controller 58 may broadcast a ping communication at a site in order to receive response pings from equipment at the site to determine which equipment is present, the controller 58 may measure, from sensor signals, the input data 66, etc.), and/or the like.

The input data 66 may include site configuration-related information 68. For example, the site configuration-related information 68 may include numbers and/or types of elements of the hydraulic fracturing system 2, powertrain types of the fracturing rigs 10 (e.g., mechanical or electric powertrain configurations), sub-types of mechanical powertrains (e.g., fuel types or levels of emission certified combustion engines), sub-types of electric powertrains (e.g., turbine generators, reciprocating engine generators, hydrogen fuel cells, energy storage systems, such as batteries, or direct-to-grid), possible operating modes of the elements of the hydraulic fracturing system 2 (e.g., an operator-based mode, a semi-closed mode, a closed mode, an autonomous mode, etc.), a maximum allowed pressure or flow rate of a fracturing rig 10 at the site, quantities and/or types of other equipment located at the site, ages, makes, models, and/or configurations of the equipment at the site, and/or the like. Additionally, or alternatively, the input data 66 may include scheduling-related information 70. For example, the scheduling-related information 70 may include times, dates, durations, locations, etc. for certain operations of the hydraulic fracturing system 2, such as scheduled times and dates for certain pump pressures, scheduled openings or closings of valves, etc.

Additionally, or alternatively, the input data 66 may include cost-related information 72. For example, the cost-related information 72 may include a cost of fuel or power for the hydraulic fracturing system 2, a total cost of ownership of elements of the hydraulic fracturing system 2 (e.g., including maintenance costs, costs of fracturing fluid, or personnel costs), a cost of emissions (e.g., regulatory costs applied to emissions or costs related to reducing emissions, such as diesel exhaust fluid (DEF) costs), and/or the like. Additionally, or alternatively, the input data 66 may include emissions-related information 74. For example, the emissions-related information 74 may include an amount of emissions from elements of the hydraulic fracturing system 2 (e.g., at different operating levels of the equipment), and/or the like. Additionally, or alternatively, the input data 66 may include equipment operation status information 75. For example, the equipment operation status may include an operational mode of equipment of the hydraulic fracturing system 2, such as for verification of requests to change the operational status of the equipment. The input data 66 may include various other types of data depending on the objective to be optimized by the optimization algorithm 76. For example, the input data 66 may include transmission gear life predictions, pump cavitation predictions, pump life predictions, engine life predictions, and/or the like.

As described in more detail herein, the optimization algorithm 76 may process the input data 66 after receiving the input data 66. For example, the optimization algorithm 76 may process the input data 66 using a particle swarm algorithm 78. The optimization algorithm 76 may then output optimized operational parameters 80 for the hydraulic fracturing system 2 to the user device 22 for viewing or modification, to the controller 58 and/or the controllers 64 to control operations of the hydraulic fracturing system 2, and/or to a database for storage. Optimized operational parameters 80 may include, for example, values for engine power output, gear ratio, engine revolutions, throttle control, pump pressure, flow rate, or transmission speed optimized for emissions output, fuel consumption, lowest cost of operation, and/or the like.

Figure 4:
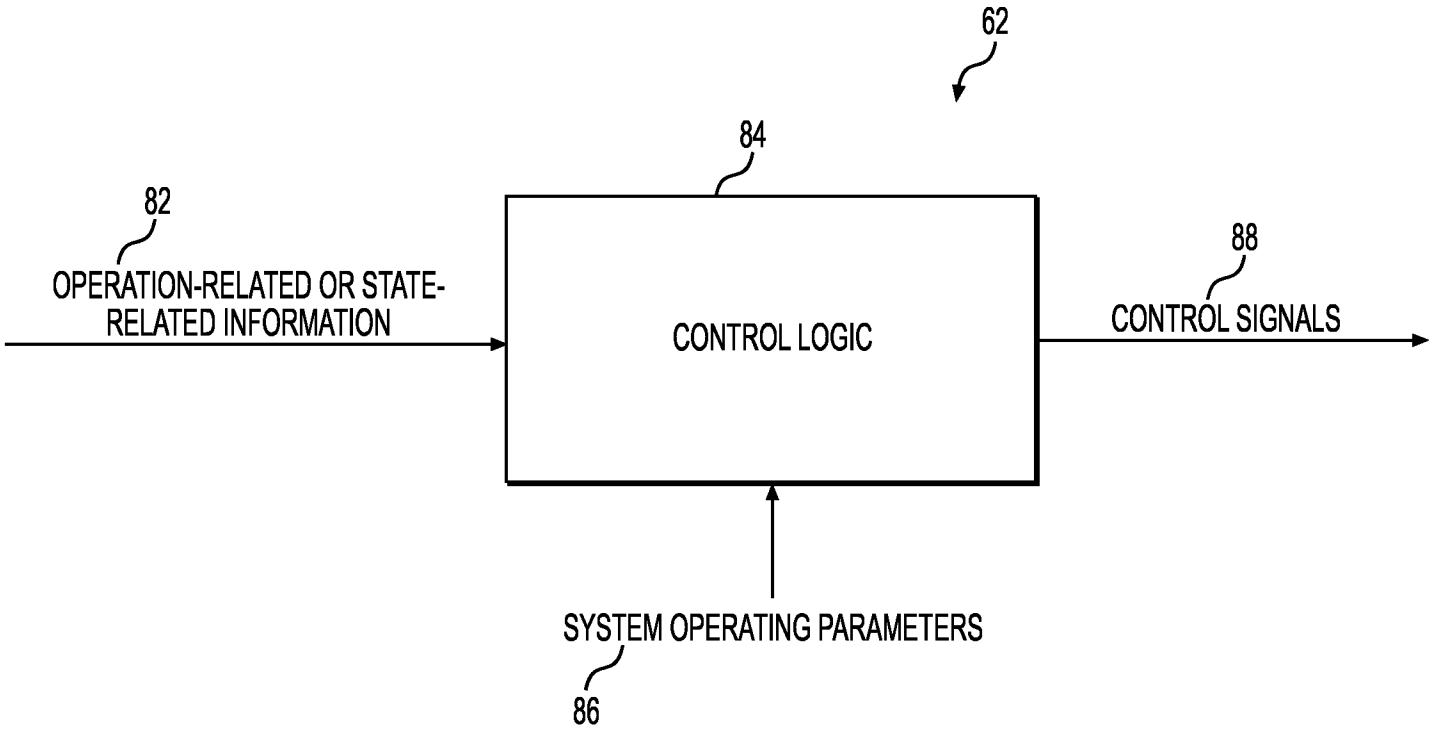
FIG. 4 is a diagram illustrating an exemplary control logic program, according to aspects of the disclosure.

FIG. 4 is a diagram illustrating an exemplary control logic program 62, according to aspects of the disclosure. As illustrated in FIG. 4, the control logic program 62 may receive operation-related or state-related information 82 and may provide this information to control logic 84. The operation-related or state-related information may include, for example, an operating pressure at a well head 18 or other elements of the hydraulic fracturing system 2, an operating transmission gear or speed of mechanical fracturing rigs 10 or power consumption of electric fracturing rigs 10, a fuel or power consumption rate or elements of the hydraulic fracturing system 2, a mixture of the fracturing fluid, whether certain types of elements or certain instances of certain types of elements are in operation, whether valves are opened or closed (or a degree to which they are opened or closed), and/or the like.

The control logic program 62 may process the operation-related or state-related information 82 using control logic 84. For example, the control logic 84 may be based on system operating parameters 86, which may include operating limits, operating expectations, operating baselines, and/or the like for the hydraulic fracturing system 2. The control logic 84 may then output control signals 88 based on the processing. For example, the control signals 88 may modify the operation of the hydraulic fracturing system 2 to avoid exceeding operating limits, to ramp operation of equipment to operating expectations, to ramp operation of equipment to exceed operating baselines, and/or the like.

INDUSTRIAL APPLICABILITY

The aspects of the controller 58 of the present disclosure and, in particular, the methods executed by the controller 58 may be used to assist in optimizing operations of various subsystems of a hydraulic fracturing system 2. Thus, certain aspects described herein may provide various advantages to the operation of the hydraulic fracturing system 2, such as optimizing the operations to reduce emissions or costs below associated thresholds while maintaining a desired operating performance of the hydraulic fracturing system 2. In addition, the controller 58 may help optimize operations of multiple different subsystems at the same time (and based on real-time or near real-time information), in a way not possible through operator-based operation of the hydraulic fracturing system 2.

Figure 5:
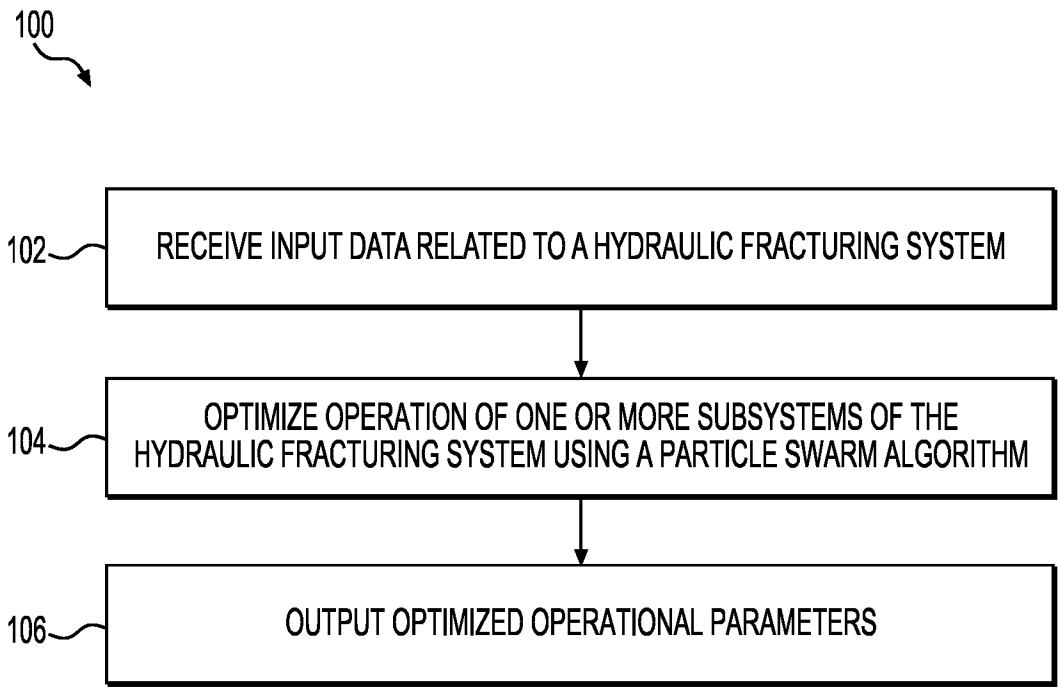
FIG. 5 illustrates a flowchart depicting an exemplary method for optimizing operations of a hydraulic fracturing system, according to aspects of the disclosure.

FIG. 5 illustrates a flowchart depicting an exemplary method 100 for optimizing operations of a hydraulic fracturing system, according to aspects of the disclosure. The method 100 illustrated in FIG. 5 may be implemented by the controller 58. The steps of the method 100 described herein may be embodied as machine readable and executable software instructions, software code, or executable computer programs stored in a memory and executed by a processor of the controller 58. The software instructions may be further embodied in one or more routines, subroutines, or modules and may utilize various auxiliary libraries and input/output functions to communicate with other equipment. The method 100 illustrated in FIG. 5 may also be associated with an operator interface (e.g., a human-machine interface, such as a graphical user interface (GUI)) through which an operator of the hydraulic fracturing system 2 may configure the optimization algorithm 76 and/or the control logic 84, may select the input data 66, the operation-related or state-related information 82, may set objectives for the optimization algorithm 76 (e.g., objectives for the particle swarm algorithm 78), and/or the like. Therefore, the method 100 may be implemented by the controller 58 to minimize emissions, costs, etc., for example.

At step 102, the controller 58 may receive input data related to a hydraulic fracturing system 2. For example, the controller 58 may receive the input data 66, the operation-related or state-related information 82, and/or the like. In connection with the receiving at step 102, the controller 58 may additionally receive a configuration for the particle swarm algorithm 78, a configuration of system operating parameters 86, and/or the like. The input data may be received from the user device 22 (e.g., as input from a user of the user device 22), from a server device (e.g., in a datacenter that is at a hydraulic fracturing site or remote to the hydraulic fracturing site), from a database, and/or the like.

At step 104, the controller 58 may optimize operation of one or more subsystems of the hydraulic fracturing system 2 using a particle swarm algorithm. For example, the controller 58 may run a particle swarm algorithm on the input data received at step 102 to iteratively tune operational parameters to search for a set of optimized operational parameters 80 ($P_1$, $P_2$, . . . $P_n$) that achieve an optimization objective. A particle swarm algorithm is described in connection with certain embodiments merely as an example, and certain embodiments may use any optimization algorithm in the art.

The controller 58 may optimize the operation for one or more objectives. For example, in determining values for optimized operational parameters 80, the controller 58 may minimize or reduce an objective, maximize or increase an objective, and/or balance two or more objectives (e.g., maximize a first objective while keeping a second objective under a threshold value). In this way, "optimized," "optimization" and similar terms used herein may refer to selection of values (for operational parameters), based on some criteria (an objective), from a set of available values. An objective may be of any suitable type, such as minimizing the cost of fracturing operations of the hydraulic fracturing system 2, minimizing fuel or power consumption of the hydraulic fracturing system 2, minimizing emissions from the hydraulic fracturing system 2, maximizing an operational life of equipment of the hydraulic fracturing system 2, minimizing an overall time of the hydraulic fracturing operations, minimizing a cost of ownership of equipment used in the hydraulic fracturing operation, maximizing a maintenance interval of equipment of the hydraulic fracturing system 2, and/or any combinations thereof. As a specific example, the controller 58 may, given minimum operational expectations, maximize fuel or power savings, minimize emissions, minimize total cost of operation or ownership of the hydraulic fracturing system 2 considering the costs of various operational parameter, balance maintenance intervals and maintenance costs, and/or the like.

A subsystem may include the blending equipment 8, the fracturing rigs 10 (e.g., mechanical and/or electric fracturing rigs 10), components of the fracturing rigs 10 (e.g., engines, pumps, transmissions, etc. for mechanical fracturing rigs 10 or variable frequency drives (VFDs) and electric motors for electric fracturing rigs 10), the low pressure missile valves 11, the large bore valves 12, the zipper valves 14 and/or zipper piping 37 and zipper valve 14 sets, the check valves 15, the well head valves 16, the well heads 18, the well head valve controller 26, the zipper valve controller 30, the large bore valve controller 36, the valve controller 40, the power source controller 48, the fuel sources 52, the power sources, and/or the like.

As one example of optimizing one or more subsystems, the controller 58 may optimize the fracturing rigs 10 and the power sources or fuel sources (e.g., may optimize the operations of the fracturing rigs 10 to minimize power or fuel costs while optimizing the fuel and power sources to help ensure that the hydraulic fracturing system 2 can meet operational expectations). As another example, the controller 58 may optimize the operation of the fracturing rigs 10 and a state of various valves of the hydraulic fracturing system 2 (e.g., may optimize these subsystems to meet minimum pressures at a well head 18, to not exceed a pressure limit at the well head 18, to prevent closure of a well, and/or the like). Additionally, or alternatively, certain embodiments may prevent cavitation on a low pressure line due to blender equipment 8 not providing enough pressure. For example, controller 58 may send an instruction to ramp down the pump experiencing cavitation and ramping up one or more other pumps to compensate for the ramped-down pumps. Additionally, or alternatively, certain embodiments may control operational efficiency to prevent loss of fuel by controlling fuel pressure, prevent loss of blending by controlling gas pressure, and/or the like. Additionally, or alternatively, certain embodiments may prevent operational interruption of an electric fracturing rig 10 by preventing loss of power or voltage, preventing start up of an electric fracturing rig 10 before a power source is ready (e.g., by checking power prior to ramping), and/or the like.

At step 106, the controller 58 may output optimized operational parameters. For example, the controller 58 may output the optimized operational parameters to one or more destinations for display (e.g., for approval and/or modification by an operator), storage (e.g., for historical comparison or analysis, for later usage, etc.), inclusion into control signals 88 (e.g., control signals that cause elements of the hydraulic fracturing system 2 to operate according to the optimized operational parameters), and/or the like. With respect to inclusion in control signals 88, the controller 58 may use a processor to generate control signals 88 and may output the control signals 88 to a controller 64 or to equipment of the hydraulic fracturing system 2 using a transceiver (or a transmitter) to cause the equipment to operate in a particular manner. In this way, the controller 58 may conserve equipment life, fuel, emissions, power, etc. of the hydraulic fracturing system 2. The one or more destinations may include the user device 22 (or a display of the user device 22), a server device, a controller, a database, memory, etc.

Although the method 100 illustrated in FIG. 5 is described as including steps 102 through 106, the method 100 may not include all of these steps or may include additional or different steps. For example, the method 100 may just include optimizing the operation at step 104 and outputting the optimized operational parameters at step 106. In addition, the method 100 illustrated in FIG. 5 may include monitoring operational parameters of the one or more subsystems and controlling the operational parameters based on operational limits, expectations, or baselines of the hydraulic fracturing system 2. For example, the controller 58 may monitor operation of equipment of the hydraulic fracturing system 2 and may control the equipment to avoid falling below a minimum suction pressure or from going lower than the low pressure limit of the system, to help ensure that minimum pressure at a well head 18 is being met, and/or the like. Additionally, or alternatively, the method 100 illustrated in FIG. 5 may include monitoring the power sources, which may include one or more auxiliary power sources, and may control the power sources to meet a power demand of the hydraulic fracturing system 2. For example, the controller 58 may monitor a power output of the power sources and may power on or power off one or more power sources, including auxiliary power sources, to meet a power demand of the hydraulic fracturing system 2.

In certain embodiments, the controller 58 may perform automated event correction. For example, the controller 58 may detect (via sensors) and/or correct cavitation while operating the blender equipment 8 and the fracturing rig 10 in a closed mode. As another example, the controller 58 may send an instruction to reduce a flow of a pump and ramp up the flow of one or more other pumps (e.g., pumps closer to the blender equipment 8) to compensate for the reduced flow. Continuing with the example, the controller 58 may control the hydraulic fracturing system 2 within operational limits and customer limits while trying to maintain an overall flow and managing individual pumps to avoid cavitation. The controller 58 may perform diagnostics of the blender equipment 8 to identify feed issues, clog issues, and/or the like. Additionally, or alternatively, and as another example, the controller 58 may correct for a pressure spike by actuating one or more valves and controlling one or more fracturing rigs 10. As a specific example, if a valve is open and the pressure of the hydraulic fracturing system 2 is at a limit based on a pump speed, the controller 58 may diagnose the cause of the pressure spike as a clog in a line.

Additionally, or alternatively, the controller 58 may detect (via sensors) and/or correct for abnormal pump vibration. For example, the controller 58 may ramp down a pump experiencing abnormal pump vibrations and ramp up one or more other pumps. Additionally, or alternatively, the controller 58 may detect (via sensors) and/or correct mechanical power source derating. For example, the controller 58 may power down the mechanical power source and power up one or more other mechanical power sources. Additionally, or alternatively, the controller 58 may detect (via sensors) a failure of dynamic gas blending (DGB) and the controller 58 may send an instruction to power on an inactive DGB unit or redistribute load among other DGB units while staying within constraints.

Additionally, or alternatively, the controller 58 may prevent an electrical power source blackout/brownout. For example, for a mixed fleet of fracturing rigs 10, the controller 58 may manage load demand while not allowing an electric pump to exceed the power available. As another example, the controller 58 may manage electric power sources based on a schedule. Additionally, or alternatively, the controller 58 may detect (via sensors) and/or correct electric pump derating (e.g., excessive motor temperature, excessive VFD temperature, etc.). For example, the controller 58 may power down an electric pump that is experiencing issues and may power on one or more other electric pumps.

In this way, the controller 58 of certain embodiments can provide real-time (or near real-time) optimization of one or more objectives for one or more hydraulic fracturing systems 2 and/or one or more subsystems of the hydraulic fracturing system 2, based on existing and planned operating conditions and limits of available equipment. This thereby may improve operation of a hydraulic fracturing system 2 from a site-level perspective by facilitating conservation of fuel and/or power, extending equipment life, reducing costs, etc. without a corresponding degradation in performance of the hydraulic fracturing system 2. In addition, through optimization of an objective, and generation of corresponding control signals 88 for equipment, certain embodiments may conserve resources (e.g., operational life, power resources, fuel resources, etc.) associated with the hydraulic fracturing system 2 and may facilitate improvements in a site or system-level efficiency of the hydraulic fracturing system 2. Site or system-level optimization may facilitate further gains in efficiency and conservation of resources compared to optimization of individual equipment through consideration of ways in which certain equipment operations affect site-level or system-level objectives. For example, if the objective for the hydraulic fracturing system 2 is to reduce fuel consumption and emissions below a threshold while maintaining a fluid pressure and an operation schedule, the controller 58 may determine that modifying any of the operation of various blending equipment 8 and the operation of various fracturing rigs 10 can reduce the fuel consumption and the emissions to a suitable level, but that just modifying the operation of the blending equipment 8 will keep the hydraulic fracturing operations on schedule.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
- one or more fracturing rigs;
- one or more blending equipment fluidly connected to inlets of the one or more fracturing rigs;
- one or more power sources electrically connected to a first subset of the one or more fracturing rigs, or one or more fuel sources fluidly connected to a second subset of the one or more fracturing rigs;
- one or more missile valves fluidly connected to outlets of the one or more fracturing rigs;
- one or more zipper valves fluidly connected to outlets of the one or more missile valves;
- one or more well head valves fluidly connected to outlets of the one or more zipper valves;
- one or more well heads fluidly connected to outlets of the one or more well head valves; and
- a controller, wherein the controller is configured to:
  - receive operation-related information for one or more subsystems of the hydraulic fracturing system,
  - optimize operation of the one or more subsystems of the hydraulic fracturing system using a particle swarm algorithm, and
  - output one or more control signals to the one or more subsystems based on optimizing the operation.

2. The hydraulic fracturing system of claim 1, wherein the one or more subsystems comprise the one or more power sources, the one or more fuel sources, and the one or more fracturing rigs.

3. The hydraulic fracturing system of claim 1, wherein the one or more power sources comprise at least one of:
- one or more utility power grids,
- one or more turbine generators,
- one or more reciprocating engine generators,
- one or more hydrogen fuel cells, or
- one or more energy storage systems.

4. The hydraulic fracturing system of claim 1, wherein the first subset of the one or more fracturing rigs comprises one or more electric fracturing rigs having one or more electric powertrain configurations.

5. The hydraulic fracturing system of claim 1, wherein the second subset of the one or more fracturing rigs comprises one or more mechanical fracturing rigs having one or more mechanical powertrain configurations.

6. The hydraulic fracturing system of claim 1, wherein the controller is further configured to operate in one or more operational modes, wherein the one or more operational modes comprise at least one of:
- a manual mode,
- a semi-closed mode,
- a closed mode,
- an autonomous mode, or
- a multi-site mode.

7. The hydraulic fracturing system of claim 1, wherein the controller, when controlling the one or more subsystems, is further configured to perform automated event correction.

8. The hydraulic fracturing system of claim 1, wherein the controller is further configured to:

monitor output of the one or more power sources, wherein the one or more power sources comprises at least one auxiliary power source, and control the one or more power sources to meet a power demand of the hydraulic fracturing system.

9. A method, comprising:

receiving information related to operation or a configuration of a hydraulic fracturing system, wherein the hydraulic fracturing system comprises:

one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, one or more missile valves fluidly connected to outlets of the one or more fracturing rigs, one or more zipper valves fluidly connected to outlets of the one or more missile valves, one or more well head valves fluidly connected to outlets of the one or more zipper valves, and one or more well heads fluidly connected to outlets of the one or more well head valves;

optimizing the operation of one or more subsystems of the hydraulic fracturing system using a particle swarm algorithm; and outputting one or more control signals to the one or more subsystems based on optimizing the operation.

10. The method of claim 9, wherein the first subset of the one or more fracturing rigs comprises one or more electric fracturing rigs or the second subset of the one or more fracturing rigs comprises one or more mechanical fracturing rigs.

11. The method of claim 9, wherein the one or more fuel sources comprise at least one of:

a compressed natural gas source, a hydrogen source, a propane source, a field gas source, a diesel source, or a gas source.

12. The method of claim 9, wherein the optimizing of the operation of the one or more subsystems comprises:

optimizing the operation of the one or more subsystems according to one or more objectives comprising at least one of:

minimizing fuel consumption of the one or more subsystems, maximizing an operational life of equipment of the one or more subsystems, minimizing a cost of operation or ownership of the one or more subsystems, minimizing emissions of the one or more subsystems, or maximizing maintenance intervals of the one or more subsystems.

13. The method of claim 9, wherein the one or more subsystems comprise the one or more power sources, the one or more fuel sources, and the one or more fracturing rigs.

14. The method of claim 9, wherein the method further comprises:

monitoring operational parameters of the one or more subsystems; and controlling the operational parameters based on operational limits, expectations, or baselines of the hydraulic fracturing system.

15. The method of claim 9, wherein the method further comprises:

monitoring output of the one or more power sources, wherein the one or more power sources comprise one or more auxiliary power sources; and controlling the one or more power sources to meet a power demand of the hydraulic fracturing system.

16. A controller for a hydraulic fracturing site, the controller being configured to:

receive information related to operation or a configuration of a hydraulic fracturing system at the hydraulic fracturing site, wherein the hydraulic fracturing system comprises:

one or more fracturing rigs, one or more blending equipment fluidly connected to inlets of the one or more fracturing rigs, one or more power sources electrically connected to a first subset of the one or more fracturing rigs, or one or more fuel sources fluidly connected to a second subset of the one or more fracturing rigs, one or more missile valves fluidly connected to outlets of the one or more fracturing rigs, one or more zipper valves fluidly connected to outlets of the one or more missile valves, one or more well head valves fluidly connected to outlets of the one or more zipper valves, and one or more well heads fluidly connected to outlets of the one or more well head valves;

optimize the operation of one or more subsystems of the hydraulic fracturing system using a particle swarm algorithm; and output one or more control signals to the one or more subsystems based on optimizing the operation.

17. The controller of claim 16, further configured, when optimizing the operation of the one or more subsystems, to:

optimize the operation of the one or more subsystems according to one or more objectives comprising at least one of:

minimizing fuel consumption of the one or more subsystems, maximizing an operational life of equipment of the one or more subsystems, minimizing a cost of operation or ownership of the one or more subsystems, minimizing emissions of the one or more subsystems, or maximizing maintenance intervals of the one or more subsystems.

18. The controller of claim 16, further configured to:

operate in one or more operational modes comprising at least one of:

an operator-based mode, a semi-closed mode, a closed mode, an autonomous mode, or a multi-site mode.

19. The controller of claim 16, further configured to:

monitor operational parameters of the one or more subsystems based on the optimizing of the operation of the one or more subsystems; and control the one or more subsystems based on operational limits, expectations, or baselines for the hydraulic fracturing system.

20. The controller of claim 16, further configured to:

monitor output of the one or more power sources, where the one or more power sources comprise one or more auxiliary power sources; and control the one or more power sources to meet a power demand of the hydraulic fracturing system.

* * * * *